United States Patent [19]

Mogi et al.

[11] Patent Number: 4,770,152

[45] Date of Patent: Sep. 13, 1988

[54] IGNITION DEVICE FOR AN INTERNAL COMBUSTION ENGINE

[75] Inventors: Kazuhisa Mogi, Susono; Eishi Ohno, Mishima, both of Japan

[73] Assignee: Toyota Jidosha Kabushiki Kaisha, Aichi, Japan

[21] Appl. No.: 114,025

[22] Filed: Oct. 29, 1987

[30] Foreign Application Priority Data

Nov. 7, 1986 [JP] Japan ..... 61-263964
Jan. 13, 1987 [JP] Japan ..... 62-2406[U]
Jan. 13, 1987 [JP] Japan ..... 62-2407[U]

[51] Int. Cl.[4] ..... F02P 1/00

[52] U.S. Cl. ..... 123/621; 123/643; 123/627

[58] Field of Search ..... 123/643, 621, 627

[56] References Cited

U.S. PATENT DOCUMENTS 1,335,933 4/1920 Bohli ..... 123/643
1,684,496 9/1928 Lautenschlager ..... 123/627
2,467,725 4/1949 Berkey et al. ..... 123/627
2,643,274 6/1953 Miller ..... 123/621
3,910,247 10/1975 Hartig ..... 123/643
4,463,744 8/1984 Tanaka ..... 123/643
4,556,040 12/1985 Heyke ..... 123/643

FOREIGN PATENT DOCUMENTS 52-156241 12/1977 Japan ..... 123/627
56-16799 4/1981 Japan ..... 123/627

*Primary Examiner*—Ronald B. Cox
*Attorney, Agent, or Firm*—Parkhurst & Oliff

[57] ABSTRACT

An ignition device for an internal combustion engine comprising an ignition coil adapted to produce a secondary reversible voltage, two wires commonly branched from the one end of the ignition coil, and two spark plugs connected to the wires. In each of the two wires, there are provided a series gap forming device and a diode. The diodes are arranged in reverse directions relative to each other, so that the secondary high voltage generated in one direction can pass through one of the diodes and the secondary high voltage in the reverse direction can pass through the other diode, whereby a spark is realized at one end of the two spark plugs by a selective application of the primary current.

9 Claims, 6 Drawing Sheets

IGNITION DEVICE FOR AN INTERNAL COMBUSTION ENGINE

BACKGROUND OF THE INVENTION

1. Field of the Invention

The present invention relates to an ignition device for an internal combustion engine, and more particularly, to an ignition device in which a distributor is omitted and a series gap utilized.

2. Description of the Related Art

A typical ignition device for a modern internal combustion engine includes an ignition coil, a distributor and spark plugs, but it is known to use a unit ignition system in which an ignition coil is provided for each cylinder of the engine and the distributor is omitted. In this system, however, it is necessary to provide a number of ignition coils corresponding to the number of engine cylinders. It is also known to use a combination of transistors and diodes to distribute the voltage surge from a single ignition coil to all of the spark plugs, and thus omit the distributor. Also, a capacitor discharge ignition (CDI) system is known, in which a capacitor is used together with a distributor and the ignition coil is omitted.

The CDI ignition system is mainly adopted for a two stroke multi-cylinder internal combustion engine, because the CDI system can produce the high voltage necessary for spark discharge at short time periods. For example, in a two stroke six-cylinder internal combustion engine, the distributing time interval must be no more than 1.7 milliseconds for each cylinder at 6,000 rpm. The CDI system can produce the necessary voltage in such a short time period, but an ignition coil system may need a time period of up to 5 milliseconds for one discharge.

The CDI ignition system, however, has a relatively small discharge energy, and thus suffers from a problem of misfires during a light load condition of the engine. In this aspect, it is preferable to use an ignition coil of the type which produces a high voltage surge when the primary current is shut off. However, it is difficult to use a distributor for a two stroke engine, since the time period for the ignition coil discharge distributed by the distributor, is not satisfactory, as above described. Therefore, it may become necessary to provide a unit ignition system having an ignition coil for each cylinder of the engine.

The two stroke engine also suffers from a problem of spark plug weak dischange.

Japanese Unexamined Patent Publication (Kokai) No. 52-156241 and Japanese Examined Utility Model Publication (Kokoku) No. 56-16799 disclose an ignition device having a series gap which is provided in series with the discharge gap of the spark plug. The series gap is advantageously used to supply an instantaneously rising high voltage, rather than a gradually rising voltage, to the spark plug, thereby preventing a weak discharge due to deposits on the electrode of the spark plug, which deposits cause an electrical leakage between the electrode and the body of the plug.

Therefore, in the case of a two stroke engine, the series gap system is preferably provided together with the unit ignition system. With this arrangement, however, the ignition coil must be made much larger in size because the series gap itself consumes discharge energy, and thus the ignition coil must have a large inductance.

Accordingly, it becomes difficult to mount a plurality of ignition coils on the engine for each cylinder.

SUMMARY OF THE INVENTION

It is an object of the present invention to provide an ignition device for an internal combustion engine, in which the conventional distributor can be omitted and the high voltage surge distributed to the spark plugs by a reduced number of ignition coils. It is another object of the present invention to provide an ignition device for an internal combustion engine, which comprises a series gap in series with the spark plug, to prevent a weak discharge by the spark plug.

The ignition device for an internal combustion engine, according to the present invention, comprises an ignition coil having a primary winding and a secondary winding and a control means for selectively applying a primary current in the reverse direction to the primary winding to produce a secondary reversible voltage at the secondary winding. The secondary winding has a first grounded end and a second end from which two wires are branched. Two spark plugs having spark gaps formed therein are connected to the wires at the ends thereof, respectively. In each of the two wires are provided means for forming a series gap in series with the respective spark gap and a diode between the respective series gap forming means and the second end of the secondary winding at which the two wires are branched. Diodes are arranged in the two wires in reverse directions relative to each other, so that the secondary high voltage generated in one direction can pass through one of the diodes and the corresponding wire and the secondary high voltage generated in the reverse direction can pass through the other diode and the associated wire, whereby a spark discharge is realized at one of the two spark plugs by a selective application of the primary current.

With this arrangement, the ignition device can distribute the high voltage from one ignition coil to two spark plugs without the need for a conventional distributor, and the series gap forming means serves to prevent a weak discharge by the spark plug.

Preferably, the primary winding includes a first winding element and a second winding element connected in series to each other, and a battery charger connected to an intermediate connecting point between the first and second winding elements with the outer ends thereof grounded, whereby the primary current can be selectively applied to the primary winding in reverse directions. The control means preferably includes transistors for controlling the selective application of the primary current in the first and second winding elements.

The spark plug comprises a central electrode and an earth electrode, and the spark gap is formed therebetween at the lower part thereof. An upper terminal extends from the central electrode and a plug cap is provided to cover the upper terminal. The series gap forming means is preferably arranged within the plug cap, which preferably has a tubular body. The terminal end of the wire and the upper terminal of the central electrode are opposedly inserted in this tubular body to define a space therebetween, the series gap forming means comprising a pair of opposed electrodes arranged in this space and connected to the terminal end of the wire and the upper terminal of the central electrode, respectively, to form the series gap. A glass tube with an inert gas filled therein is arranged in the space in the tubular body, and the opposed electrodes extend into this glass tube. The glass tube is preferably supported in the tubular body by a rubber cushion member.

Preferably, the diode is also arranged in this tubular body in such a manner that the diode is located at a position near the series gap. Preferably, the diode has a predetermined resistance characteristic in the forward direction.

BRIEF DESCRIPTION OF THE DRAWINGS

The present invention will become more apparent from the following description of the preferred embodiments with reference to the accompanying drawings, in which.

DESCRIPTION OF THE PREFERRED EMBODIMENTS

Figure 1:
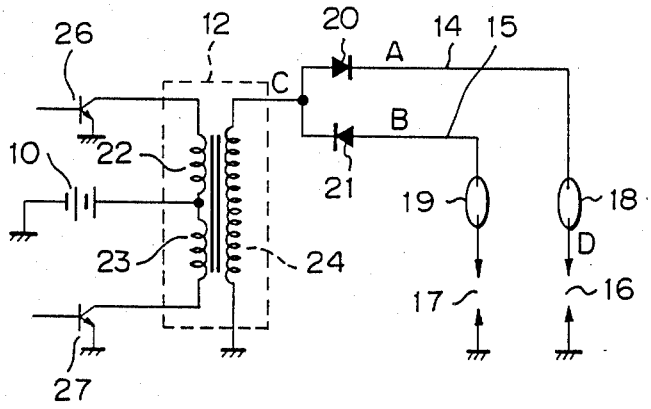
FIG. 1 is a diagrammatic view showing an ignition device for an internal combustion engine according to the present invention.

Referring to FIG. 1, the ignition device according to the present invention comprises a battery charger 10, an ignition coil 12, two high tension cables 14 and 15, two spark plugs 16 and 17 connected to the ends of the high tension cables 14 and 15, respectively, two series gap forming means 18 and 19 arranged in series with the spark plugs 16 and 17, respectively, and two diodes 20 and 21.

The ignition coil 12 comprises two primary winding elements 22 and 23 connected in series to each other and a secondary winding 24. The battery charger 10 is connected at the positive pole thereof to the primary winding, at an intermediate connection point between the primary winding elements 22 and 23. The outer ends of the primary winding elements 22 and 23 are grounded through transistors 26 and 27. The transistors 26 and 27 control the primary current through commands from a control unit (not shown). When the transistor 26 is switched on, the primary current flows through the primary winding element 22 toward the battery charger 10 in one direction. Alternatively, when the transistor 27 is switched on, the primary current flows through the primary winding element 23 also toward the battery charger 10, but the current direction is the reverse of the former current direction. Therefore, it is possible to produce a secondary reversible voltage at the secondary winding 24 by a selective application of the primary current.

One end of the secondary winding 24 is grounded, and the two high tension cables 14 and 15 are branched from the other end. The diodes 20 and 21 are located in the high tension cables 14 and 15, in the reverse direction relative to each other, between this branch point and the respective series gap forming means 18 and 19, respectively. Therefore, the current flows through either one of the diodes 20 and 21 in accordance with the direction of the generated secondary voltage, whereby the associated plug of the two spark plugs 16 and 17 discharges a spark.

Figure 2:
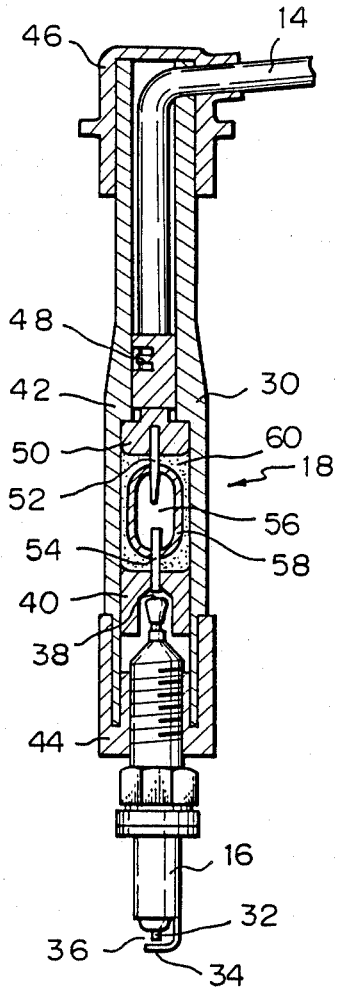
FIG. 2 is a sectional view showing a spark plug with a plug cap in which a series gap is arranged.

FIG. 2 shows an example of the series gap forming means 18, which is arranged in the plug cap 30 of the spark plug 16. As is well known, the plug cap 30 is attached to the end of the high tension cable 14 to provide an electric connection between the spark plug 16 and the ignition coil 12. The spark plug 16 comprises a central electrode 32 and an earth electrode 34, and a spark gap 36 is formed therebetween at the lower part of the spark plug 16. An upper terminal 38 extends from the central electrode 32 in the centre of the spark plug 16. The plug cap 30 covers at least this upper terminal 38 and has a connector 40 adapted to allow a connection to the upper terminal 38.

The plug cap 30 comprises a tubular body 42 made of an insulating plastic material, with a rubber bush 44 fitted at the bottom of the tubular body 42 and a rubber cap 46 at the top thereof, for waterproofing. This rubber cap 46 is designed to fit the cylinder head cover (not shown) and retain the high tension cable 14 thereat.

The high tension cable 14 is inserted in the plug cap 30 and a terminal end 48 thereof is connected to a connector 50. The opposed connectors 40 and 50 define a space therebetween. The series gap forming means 18 comprises a pair of opposed tungsten needle electrodes 52 and 54 with a gap 56 formed therebetween. This gap 56 is called a series gap. The electrode 52 is carried in a downward projecting position by the connector 50, and the electrode 54 is carried in an upward projecting position by the connector 40. A hard glass tube 58 is arranged in the space between the connectors 40 and 50, and an inert gas, for example, nitrogen gas or the like, is filled in the glass tube 58. The electrodes 52 and 54 extend into this glass tube 58 to form the series gap 56 within this glass tube 58. The glass tube 58 is supported in the tubular body 42 by a cushion member 60 made of silicon rubber and surrounding the glass tube 58 to prevent a flashover through the wall of the glass tube 58. The cushion member 60 protects the fragile glass tube 58 and series gap forming means 18 from shock.

The operation of the ignition device of FIG. 1 is as follows.

Figure 3:
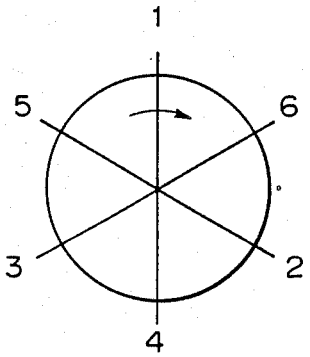
FIG. 3 is a diagram showing the firing order of the two stroke engine.

This ignition device is intended for use with a two stroke six-cylinder internal combustion engine, for distributing a high voltage surge to a set of two cylinders thereof which are disposed at 180 crank angles. If the firing order of this two stroke engine is cylinder Nos. 1, 6, 2, 4, 3, 5, as shown in FIG. 3, the pair of spark plugs 16 and 17 are mounted, for example, on Nos. 1 and 4 cylinders.

The two stroke engine having a crankshaft and pistons performs one combustion cycle for each revolution of the crankshaft, comprising the piston upward stroke and piston downward stroke. The two stroke engine includes a scavenging action in which the exhaust and intake actions are substantially simultaneously carried out. For example, if the two stroke engine is constructed so that the exhaust and intake valves are arranged in the cylinder head, as in a conventional four stroke engine, the exhaust valve is opened at a point $E_o$ after the top dead center (TDC) and closed at a point $E_c$ after the bottom dead center (BDC), and the intake valve is subsequently opened at a point $F_o$ and closed at a point $F_c$ slightly later than the point $E_o$ and point $E_c$, respectively. When the intake valve is closed, the compression action is commenced and ignition is carried out at a point I before TDC. It will be understood that a point advanced by a half cycle, namely, 180 crank angles from the ignition point I, is the next intake action.

The pair of spark plugs 16 and 17, as shown in FIG. 1, are connected to the common secondary winding 24 of the ignition coil 12. If these spark plugs 16 and 17 discharge simultaneously, one of the spark plugs 16 may ignite at the correct ignition point I of that cylinder, but the other spark plug 17 may ignite during the suction action of the associated cylinder. Preferably the ignition is not carried out in the suction stroke because undesirable phenomena, such as post-ignition or backfiring, takes place. Therefore, in the two stroke engine, the two ignitions must not occur in one cylinder during one cycle. Conversely, a point after a half cycle from the compression stroke is an exhaust stroke, and thus there is little problem even if the pair of the spark plugs discharge simultaneously, since one discharges at a correct ignition point and other discharges during the exhaust stroke, wherein combustion cannot take place. Therefore, the ignition device, as shown in FIG. 1, is especially useful for two stroke engines but can be used for four stroke engines.

It will be clear, according to the present invention, that the pair of spark plugs 16 and 17 do not discharge simultaneously, since the diodes 20 and 21 are arranged in the reverse direction to each other and the secondary winding 24 of the ignition coil 12 produces a secondary voltage alternatively in the reverse direction. Therefore, when one of the spark plugs 16 and 17 discharges at a correct ignition point I of that cylinder, the other plug does not discharge during the suction stroke of the associated cylinder.

Figure 4:
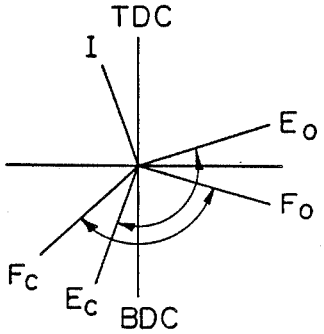
FIG. 4 is a diagram showing a valve operation timing and spark timing of the two stroke engine.
Figure 5:
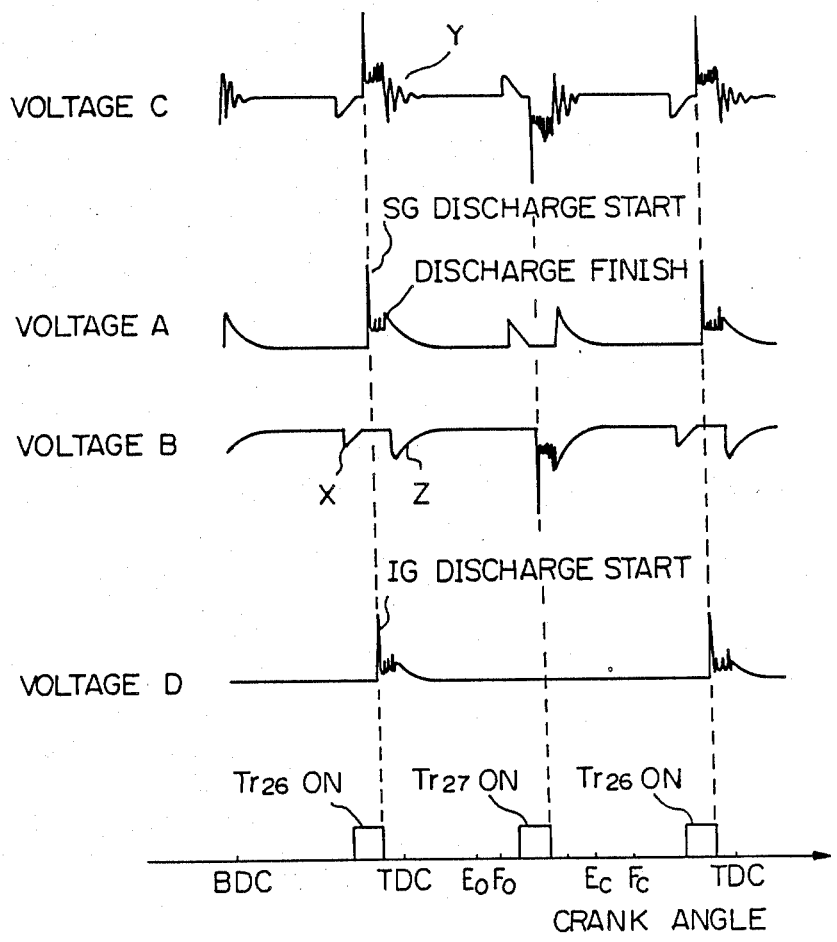
FIG. 5 is a timing chart illustrating the operation of the ignition device in FIG. 1.

An example of transistor driving signals is illustrated at the bottom of FIG. 5, which signals are delivered by the computer control unit (not shown) to the transistors 26 and 27 alternately. The horizontal axis of FIG. 5 is a crank angle of No. 1 cylinder of the engine, and the valve operating timings shown are marked on the horizontal axis, in correspondence with those shown in FIG. 4. The ignition timing I is in the compression stroke before TDC. FIG. 5 further shows examples of Voltage A to Voltage D, which represent the voltages at point A to D in FIG. 1, respectively. Voltage A and Voltage B are those applied to the series gap forming means 18 and 19 through the diodes 20 and 21, respectively; voltage C is that of the branch point A at which the two high tension cables branch; and, voltage D is that applied to the spark plug 16 on No. 1 cylinder.

It will be understood that a minor "ON" voltage occurs in the secondary winding 24 of the ignition coil 12 when the transistors 26 and 27 are selectively switched ON, and then a major high voltage surge occurs in a reverse direction when the transistors 26 and 27 are switched OFF (Voltage C in FIG. 5). This major high voltage surge occurring when the transistors 26 and 27 are switched OFF is conventionally used for discharge of the spark plugs 16 and 17. The minor "ON" voltage is not sufficient to be used for a discharge of the spark plug, and thus this voltage is shut OFF by the associated diode 20 or 21 (since this is in a reverse direction to the major high voltage surge). However, this voltage may pass through the other diode, as described later.

The direction of the secondary high voltage surge is changed in accordance with the selective control of the transistors 26 and 27, since the directions of the primary windings 22 and 23 are reversed. Each of the diodes 20 and 21 allows a respective forward flow only, and accordingly, the high voltage surge in one direction passes through one of the high tension cables 14 and 15 (Voltage A) and the high voltage surge a half cycle behind in the reverse direction passes through the other of the high tension cables 14 and 15 (Voltage B). Therefore, the high voltage surge is applied alternately to one of the two series gap forming means 18 and 19 and spark plugs 16 and 17, resulting in one ignition during one cycle in one cylinder.

The main three functions of the series gap 56 (series gap forming means 18) are now described. The first function of the series gap 56 is to prevent a weak discharge by the spark plug 16. The secondary high voltage surge rising gradually with time is transferred to the series gap 56 through the respective high tension cable 14 or 15, and applied to the opposing electrodes 52 and 54 thereof, although in FIG. 5 it appears to rise instantaneously like a pulse. The series gap 56 prevents, at the initial stage of the operation, a direct application of this secondary high voltage surge to the spark plug 16. Then the secondary high voltage will rise to a predetermined value to discharge the series gap 56 (SG DISCHARGE START), and at that time, the secondary high voltage is applied to the spark plug 16 and will be discharged (IG DISCHARGE START). In this way, since the high voltage is instantaneously applied to the spark plug 16, the plug will discharge the voltage to ignite the air-fuel mixture.

This is based on the following. A weak discharge usually occurs when the insulation resistance between the central electrode 32 and the earth electrode 34 of the spark plug 16 is reduced and a leakage current therebetween is increased, so that an increase in the voltage supplied from the ignition coil 12 to the spark plug 16 is obstructed. When the series gap 56 is arranged in series with the spark plug 16, the spark plug 16 can be instantaneously supplied with a sufficiently raised voltage to ensure a full spark after a time period from the triggering of the ignition coil 12, during which the main secondary voltage is rising at the series gap 56. The above described leakage current grows in that time period if there is no series gap. The two stroke engine specially tends to have a poor ignitability if a weak discharge occurs, and thus the inclusion of the series gap 18 for preventing such a weak discharge is particularly advantageous for two stroke engines.

The second function of the series gap 56 is the prevention of an undesirable ignition by the above described "ON" voltage. This "ON" voltage is generated at the ignition coil 12, when, for example, the transistor 26 is switched ON, in reverse to the main high voltage generated when the transistor 26 is switched OFF. This "ON" voltage is not transferred to the No. 1 cylinder, which can accept a spark because of the associated diode 20 (Voltage A), but is supplied to the other No. 4 cylinder as represented by X in the Voltage B. The No. 4 cylinder is in an intake stroke and filled with fresh air or a mixture of approximately 1 atmospheric pressure. This "ON" voltage is usually low, for example, approximately 3 to 4 kilovolts, but occasionally may be sufficient to induce a discharge of the spark plug to ignite the mixture. According to the present invention, however, the series gap 19 has a preselected considerably higher discharge voltage than the "ON" voltage, so that the "ON" voltage is securely shut OFF, and thus an incorrect discharge of the spark plug 17 is prevented.

The third function of the series gap 56 is the prevention of a resonance voltage, generated at the finish of the discharge. Considering, for example, the case in which the discharge is effected at No. 1 cylinder and the mixture therein is combusted. The discharge will finish, as illustrated in Voltage A in FIG. 5, if the spark of the spark plug 16 is extinguished by the turbulent mixture. At this time, some magnetic energy remains in the secondary winding 24 of the ignition coil 12, so that a resonant voltage Y (in Voltage A) is generated between the secondary winding 24 and the stray capacitance on the secondary winding 24 and the high tension cable 14, and thus a resonant voltage Z is applied to Nos. 1 and 4 cylinders. Similar to the previous description regarding the "ON" voltage, No. 4 cylinder is in an intake stroke and a combustion may be induced. However, the series gap 19 prevents an incorrect discharge of the spark plug 17.

Figure 6:
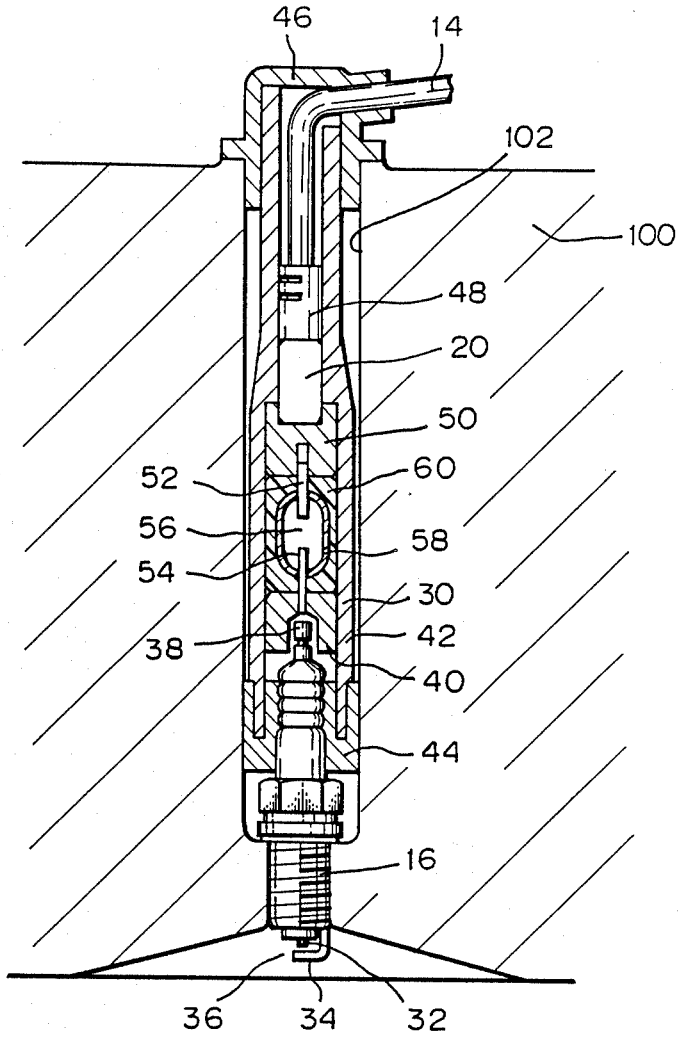
FIG. 6 is a sectional view similar to FIG. 2 but showing a second embodiment of the present invention including a spark plug, a series gap, and a diode arranged in the plug cap.

Referring now to FIG. 6, the second embodiment of the present invention comprises a spark plug 16 and a series gap forming means 18, which can be used for the ignition device of FIG. 1. The spark plug 16 and series gap forming means 18 are similar to those of FIG. 2 and the series gap forming means 18 is also arranged in a plug cap 30 of the spark plug 16, and accordingly, like elements in FIG. 6 are represented by the corresponding numeral of FIG. 2. The spark plug 16 with the plug cap 30 is inserted in a mounting aperture 102 provided in a cylinder head 100. The upper rubber cap 46 is adapted for retaining the high tension cable 14 at the cylinder head 100.

According to the second embodiment of the present invention, the diode 20 is also arranged in the plug cap 30 of the spark plug 16. More particularly, the diode 20 is arranged between the terminal 48 of the high tension cable 14 and the connector 50 for the series gap electrode 52, to establish an electric connection therethrough, in the selected forward direction of the diode 20. FIG. 1 shows the forward direction of the diode 20, and the other diode 21 is arranged in the reverse direction in the associated plug cap.

Figure 7:
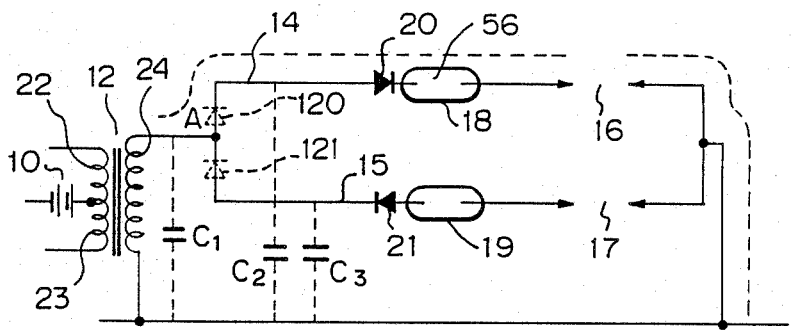
FIG. 7 is a diagrammatic view illustrating the operation of the ignition device with the diode arranged according to FIG. 6.

FIG. 7 illustrates the flow passage of the secondary voltage when the voltage is applied to the series gap forming means 18 and spark plug 16, and the formation of the stray capacitances. The diodes 20 and 21 are adjacent to the respective series gap forming means 18 and 19; this arrangement is derived from the structure of FIG. 6 in which both the series gap forming means 18 and the diode 20 are inserted in the plug cap 30. Also, as shown by phantom lines, diodes 120 and 121 are located at positions near the branching point A, supposing that diodes 120 and 121 are arranged in the housing of the ignition coil 12.

Before the discharge of the series gap forming means 18, electrons are floating on the conductor between the ignition coil 12 and the electrode 52 of the series gap forming means 18, because the series gap 56 has shut OFF the flow of current. This means that the electrons are charged on naturally formed stray capacitances $C_1$ between the earth and the ignition coil 12, $C_2$ between the earth and the high tension cable 14 between the branching point A and the series gap forming means 18, and $C_3$ between the earth and the high tension cable 15 between the branching point A and the series gap forming means 19. The total capacitances $C_1$, $C_2$, and $C_3$ can be used to enable a discharge of one of the series gap forming means 18 and 19, since the diodes 20 and 21 are arranged adjacent to series gap forming means 18 and 19, respectively. The enlarged capacitance, obtained by using the capacitance of the other of the high tension cables 14 and 15, provides an advantageous effect of a faster rise of the discharge voltage. Conversely, one of the capacitances $C_2$ and $C_3$ cannot be used if the diodes and 120 and 124 are arranged at the positions, shown by phantom lines in the Figure, since one of the diodes 120 and 124 will prevent the flow of the charges. Further, if the diodes 20 and 21 are arranged adjacent to the series gap forming means 18 and 19, respectively, the electrons are charged commonly on the high tension cables 14 and 15, so that the total stray capacitance between the two diodes 20 and 21 remains equal even if the direction of the current is changed. Therefore, it is possible to effect the discharge at a constant intensity even if the lengths of the high tension cables 14 and 15 are different.

Figure 8:
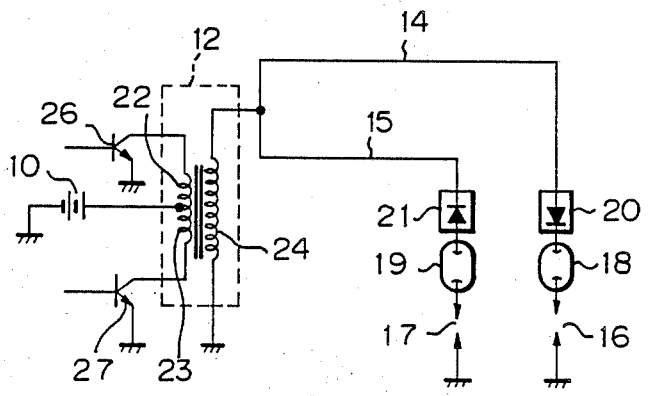
FIG. 8 is a diagrammatic view showing an ignition device according to the third embodiment of the present invention including a diode having a low resistance.

FIG. 8 shows a third embodiment of the present invention, which fundamentally comprises similar elements to those of FIG. 1.

Figure 9:
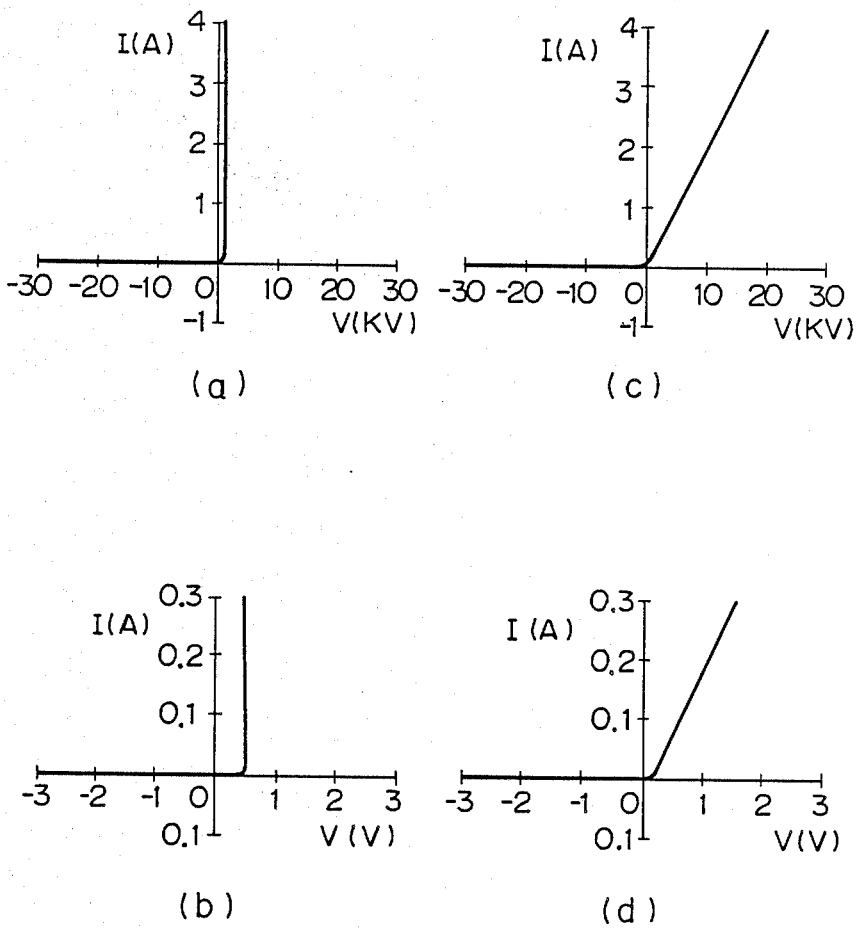
FIGS. 9 *a* through *d* shows graphs of the V-I characteristics of a conventional non-resistance diode and the diode having a low resistance shown in FIG. 8.

In FIG. 8, the diodes 20 and 21 are arranged in the plug caps 30 of the spark plugs 16 and 17, respectively, as in the previous embodiment. Each of the diodes 20 and 21 of this embodiment has a predetermined resistance characteristic in the forward direction. FIG. 9 shows the current-to-voltage relationship of two available types of diodes. Most general diodes have the characteristics shown in (a) and (b), and it will be clear that the resistance in the forward direction is substantially zero. Some diodes have the characteristics shown in (c) and (d), and thus exhibit a substantial resistance in the forward direction. This embodiment uses the latter type of diodes, particularly those diodes which are capable of withstanding a high voltage of, for example, 30 kilovolts, and have an internal resistance of 3 to 5 kiloohms, which can restrict a current of several tens of amperes. Such a current is generated when the series gap 56 discharges, since this discharge is a capacity discharge, and such an intense current causes radio noise, and thus, should be restricted to a low value. This is accomplished by the diodes 20 and 21 having a predetermined resistance characteristic in the forward direction.

We claim:

1. An ignition device for an internal combustion engine, comprising:

an ignition coil having a primary winding means and a secondary winding means;

control means for selectively applying a primary current in reverse directions to said primary winding means to produce a secondary reversible voltage at said secondary winding means;

two wire means branched from one end of said secondary winding means;

two spark plugs having spark gaps formed therein and connected to said wire means at ends thereof, respectively;

means for forming a series gap in each of said two wire means in series with said respective spark gap; and diodes arranged in said two wire means respectively, in reverse directions relative to each other between said respective series gap forming means and said one end of said secondary winding means, whereby one of said two spark plugs is discharged by a selective application of said primary current.

2. An ignition device according to claim 1, wherein said primary winding means includes a first winding element and a second winding element connected in series to each other, and a battery charger connected between an intermediate connecting point between said first and second winding elements and respective outer ends thereof grounded, thereby said primary current is selectively applied to said primary winding means in the reverse directions.

3. An ignition device according to claim 2, wherein said control means includes transistors for controlling a selective application of the primary current in the first and second winding elements.

4. An ignition device according to claim 1, wherein said spark plug comprises a central electrode and an earth electrode and said spark gap is formed therebetween at the lower part thereof, an upper terminal extending from said central electrode and a plug cap covering said upper terminal, said series gap forming means being arranged within said plug cap.

5. An ignition device according to claim 4, wherein said plug cap comprises a tubular body, said end of said wire means being inserted in said tubular body of said plug cap from one end thereof and said upper terminal of said central electrode being also inserted in said tubular body from the other end to define a space therebetween, said series gap forming means comprising a pair of opposed electrodes arranged in said space and connected to said end of said wire means and said upper terminal of said central electrode, respectively, to form said series gap.

6. An ignition device according to claim 5, wherein a glass tube with an inert gas filled therein is arranged in said space in said tubular body of said plug cap, said opposed electrodes extending into said glass tube to form said series gap in said glass tube.

7. An ignition device according to claim 6, wherein said glass tube is supported in said tubular body by a cushion member.

8. An ignition device according to claim 4, wherein said diode together with said series gap forming means is arranged in said tubular body of said plug cap.

9. An ignition device according claim 1, wherein said diode has a predetermined resistance characteristic in a forward direction to prevent noise.

* * * * *